US008733502B2

(12) United States Patent
Larson

(10) Patent No.: US 8,733,502 B2
(45) Date of Patent: May 27, 2014

(54) FOLDABLE DUAL TRACK LADDER SYSTEM

(75) Inventor: Roger Larson, White Bear Lake, MN (US)

(73) Assignee: Material Control, Inc., Croswell, MI (US)

( * ) Notice: Subject to any disclaimer, the term of this patent is extended or adjusted under 35 U.S.C. 154(b) by 0 days.

(21) Appl. No.: 13/474,413

(22) Filed: May 17, 2012

(65) Prior Publication Data

US 2012/0292130 A1 Nov. 22, 2012

Related U.S. Application Data

(60) Provisional application No. 61/519,094, filed on May 17, 2011.

(51) Int. Cl.
*E04G 1/38* (2006.01)

(52) U.S. Cl.
USPC ..... 182/39

(58) Field of Classification Search
USPC ..... 182/39
See application file for complete search history.

(56) References Cited

U.S. PATENT DOCUMENTS

| | | | | |
|---|---|---|---|---|
| 3,693,756 | A * | 9/1972 | Walker et al. | 182/129 |
| 4,388,982 | A * | 6/1983 | Yonahara | 182/82 |
| 5,413,191 | A | 5/1995 | Kerr | |
| 5,480,002 | A | 1/1996 | Kerr | |
| 5,653,307 | A | 8/1997 | Kerr | |
| 6,619,427 | B1 | 9/2003 | Kerr | |
| 7,757,813 | B2 | 7/2010 | Kerr | |
| 2001/0035704 | A1 * | 11/2001 | Dierbeck | 312/902 |
| 2009/0301812 | A1 * | 12/2009 | Kerr | 182/39 |
| 2010/0300805 | A1 * | 12/2010 | Moss et al. | 182/18 |

* cited by examiner

*Primary Examiner* — Katherine Mitchell
*Assistant Examiner* — Kristine Florio
(74) *Attorney, Agent, or Firm* — Dykema Gossett PLLC

(57) ABSTRACT

The disclosed ladder system may be disposed in a store, warehouse, library, or similar facility where two storage shelves form an aisle. The ladder can be pivotally attached to a roller structure that moves along a length of the aisle on a guide track. The guide track may be disposed along sides of the storage shelves. The roller structure may be formed by a lateral rod extending between and coupled to two roller carriages. Further, because the ladder is pivotally attached to the roller structure, the ladder may fold substantially out of the aisle when the ladder is not in use.

19 Claims, 10 Drawing Sheets

FOLDABLE DUAL TRACK LADDER SYSTEM

CROSS-REFERENCE TO RELATED APPLICATIONS

This application claims the benefit of U.S. provisional application No. 61/519,094, filed May 17, 2011, which is hereby incorporated by reference as though fully set forth herein.

FIELD OF THE INVENTION

The present invention relates generally to ladder systems. More specifically, the present invention relates to ladder systems for use with a pair of spaced storage shelves in a store, library, warehouse, or the like.

BACKGROUND OF THE INVENTION

Older ladder systems oriented within narrow aisles in some stores and warehouses were too wide and consumed too much of the width of the aisle. Employees of such stores and warehouses had difficulty passing the ladder, particularly when they were carrying packages or some other object. In one region, a local code even forbade the use of a dual track ladder of this type.

More recent ladder systems have been redesigned to include a feature that will permit it to fold out of the way against a rack or storage shelf when not in use. With this feature, the ladder system occupies a much smaller portion of the aisle width. As a result, employees of stores and warehouses using these ladder systems can pass by the ladder system in the aisle without difficulty.

An example of a more recent ladder system is shown in FIG. 1, which has been reproduced from U.S. Pat. No. 6,619,427 to Kerr (hereafter "Kerr"). In Kerr, a ladder 20 is positioned between storage shelves 22, 24 defining an aisle 26. The ladder 20 is slidably attached to a first lateral rod 28 of an overhead roller structure 30, meaning the ladder 20 can translate along the first lateral rod 28. The overhead roller structure 30 also includes a second lateral rod 32 in some embodiments, with the first and second lateral rods 28, 32 connected to and extending between first and second longitudinal members 34, 36. The first and second longitudinal members 34, 36 are slidably attached to an overhead guide track 38 extending along the storage shelves 22, 24. Thus, the ladder 20 can also move longitudinally along the aisle 26 because the overhead roller structure 30 can translate longitudinally along the overhead guide track 38.

Kerr also teaches that the ladder 20 can fold mostly out of the way of the aisle 26 due to a pivot 40 and a latch 42. When the ladder 20 is not in use, an employee can disengage the latch 42 and rotate the ladder 20 about the pivot 40. Once rotated, the ladder 20 is positioned substantially against the storage shelf 22, making the aisle 26 much more passable.

Yet even recent ladder systems have room for improvement in some environments. Many existing ladder systems have very large overhead roller structures with two lateral rods. For one, large roller structures can be difficult to ship or store when not in use, especially where the roller structures are welded together. Also, a large roller structure inhibits the ladder from traveling to ends of the aisles. The roller structures are long to accommodate at least two lateral rods. The guide tracks mounted on the shelves, moreover, do not extend beyond the ends of the shelves. Therefore, even though distal ends of the roller structure may travel to the ends of the aisles, the ladder cannot travel to the ends of the aisles since the ladder is generally centered along a length of the roller structure. Objects on shelves that are elevated and stored towards the end of the aisles can be difficult to access.

Still further, many existing ladder systems are unnecessarily complex, particularly at the attachment point(s) between the overhead roller structure and the ladder. Many stores, libraries, warehouses, and the like do not have aisles that require ladders to move laterally in an aisle between the shelves. Many existing ladder systems include additional roller structures for this purpose, however. While this capability may be advantageous in warehouses (1) with wide aisles that (2) require employees to move quickly from one shelf to an opposing shelf in the same aisle, this additional roller structure is overkill for many if not most stores, libraries, warehouses, and the like.

Thus, there is a long-felt need for a ladder system that has a compact overhead roller structure and that is not unnecessarily complex.

SUMMARY OF THE INVENTION

The disclosed ladder system is intended to be used in aisles formed by pairs of storage shelves that are positioned on floors of warehouses, stores, libraries, and the like. These aisles may be said to have a width and a length. In some embodiments, the ladder system may have a guide track, a roller structure, a mounting plate, a pivot, a ladder, and a latch mechanism.

The guide track may be formed of numerous members that extend longitudinally along the length of an aisle. These longitudinal members may be attached to support columns of the shelves, or sides of individual shelves. The guide track may support a roller structure that is slidably attached to the guide track. The roller structure may include a pair of roller carriages that can slide or translate along the guide track, and the roller carriages have a lateral rod extending between and coupled to them. It may be said that one of the roller carriages is adjacent to one of the pair of storage shelves, while the other roller carriage is adjacent to the other storage shelf. In short, however, the roller structure can travel longitudinally down the length of an aisle.

A mounting plate may be affixed to the lateral rod of the roller structure. In one embodiment, the mounting plate can be attached to the lateral rod with two U-bolts. Moreover, the mounting plate may have first and second ends that are generally distal to each other. One of these ends may accommodate a pivot between the mounting plate and the ladder, while the other end may accommodate a latch mechanism, such that the ladder can be selectively secured to the mounting plate. In some embodiments, the latch mechanism may be onboard the mounting plate. In other embodiments, the latch mechanism may be onboard the ladder. In still other embodiments, the latch mechanism may be best characterized by saying that both the ladder and the mounting plate have components that define the latch mechanism. The same goes for the pivot, which pivotally attaches the ladder to the mounting plate.

Due to the latch mechanism and the pivot, the ladder may be capable of being maintained in two positions: a deployed position and a folded position. In the deployed position, the ladder is secured to the mounting plate at the pivot and at the latch mechanism. In the deployed position, the ladder occupies a portion of the aisle and is ready for use. And because the mounting plate is attached to the roller structure, the ladder may move longitudinally in the aisle. On the other hand, when the latch mechanism is selectively released, a spring, piston, or other device may force the ladder away from the mounting bracket. Hence, the ladder may rotate about the pivot away from the mounting bracket. The ladder may come to rest in the folded position, stowed adjacent to one of the storage shelves. In the folded position, the ladder occupies significantly less width of the aisle, and the aisle is much more passable.

BRIEF DESCRIPTION OF THE DRAWINGS

Further embodiments and aspects of the invention are indicated in the figures and in the remaining description. The invention will now be explained in a non-limiting manner by way of examples depicted in the drawings. In the exemplary drawings.

DETAILED DESCRIPTION OF THE INVENTION

The disclosed ladder system may be used between storage shelves in a store, library, warehouse, or the like. The storage shelves are usually mounted on a floor of a building, with space between the shelves defining an aisle. For reference and purposes of clarity, "longitudinal" may refer to a direction generally parallel to the storage shelves or generally parallel to a length of the aisle. The term "lateral" may refer to a direction generally orthogonal to the storage shelves or generally parallel to a width of the aisle.

Further, the disclosed ladder system may generally include a guide track, a roller structure, and a ladder. Each will be described in turn.

Figure 1:
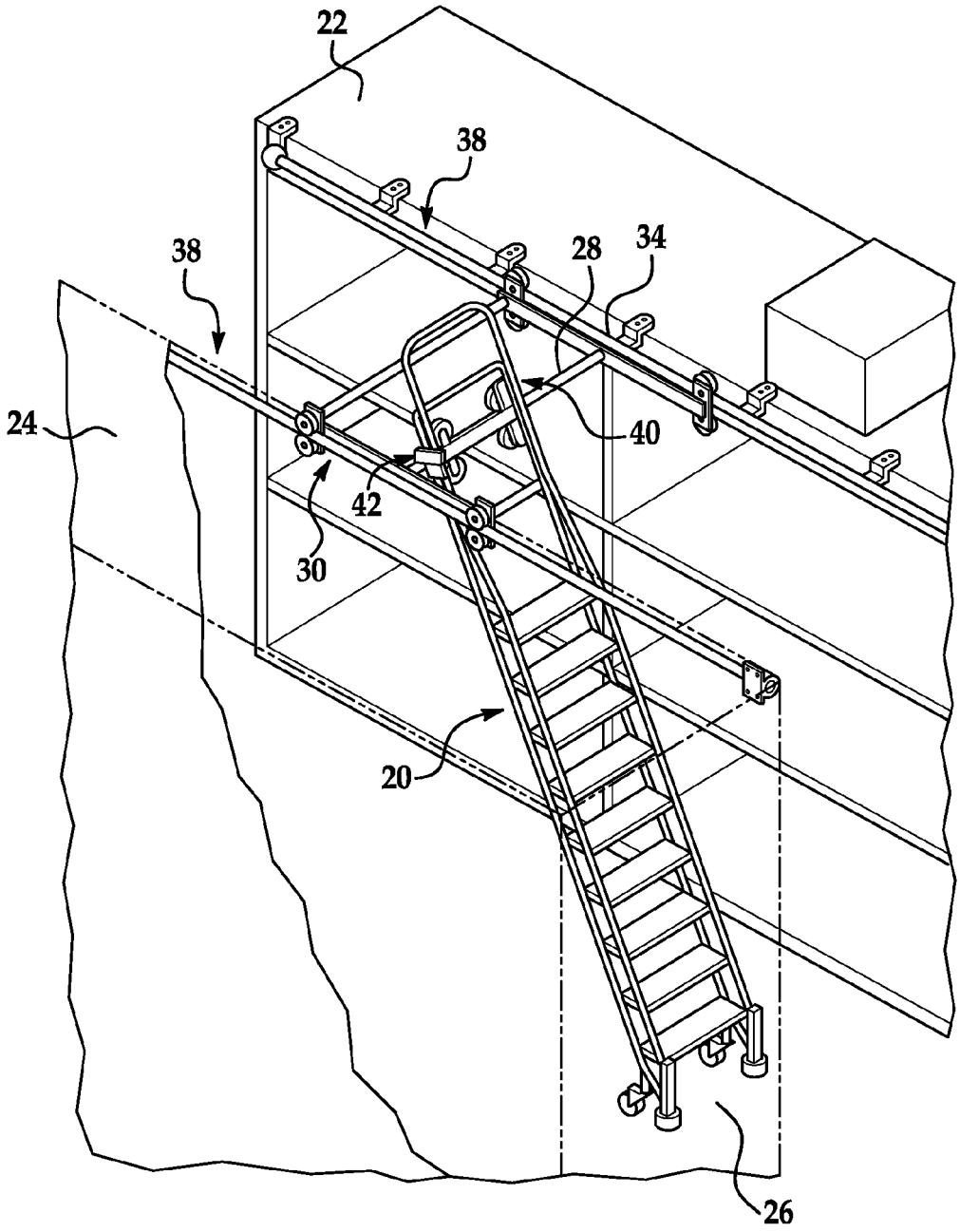
FIG. 1 PRIOR ART
FIG. 1 is a partially cut away perspective view of a prior art ladder system, with the ladder being located in an aisle between laterally spaced storage shelves.
Figure 2:
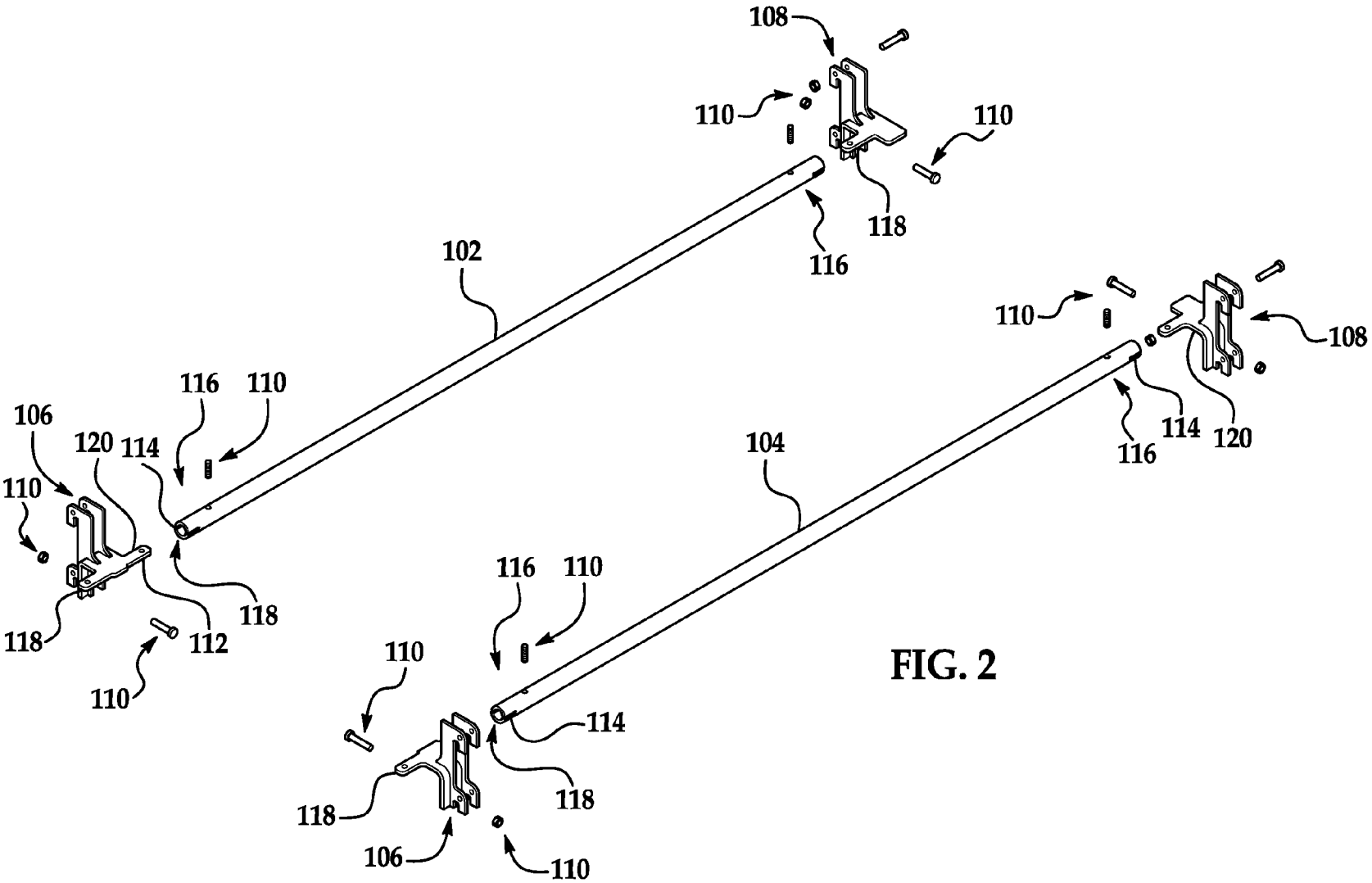
FIG. 2 is an exploded view of a segment of a guide track that can be mounted to storage shelves according to an embodiment of the disclosed ladder system.

Turning now to the figures that embody the inventive ladder system and components thereof, FIG. 2 shows a guide track 100 that may be mounted to shelves defining an aisle. The guide track 100 may generally include a plurality of longitudinal members, such as first and second longitudinal members 102, 104; a plurality of brackets 106; a plurality of end mounts 108; and a plurality of fasteners 110.

Although FIG. 2 only shows two longitudinal members 102, 104, the guide track 100 may include many longitudinal members, or at least as many as are required to span the length of the aisle. In one embodiment, the first and second longitudinal members 102, 104 may be hollow and formed of steel. The first and second longitudinal members 102, 104 may have openings 112 with slots 114 at their ends 116. During and after assembly of the guide track 100, flanges 118 of the brackets 106 and end mounts 108 may be disposed within the openings 112 of the longitudinal members 102, 104. The flanges 118 may be sized to fit snugly within the openings 112 of the longitudinal members 102, 104. A snug fit may help prevent the longitudinal members 102, 104 from becoming displaced from the brackets 106 and the end mounts 108. The longitudinal members 102, 104 may also be connected to the brackets 106 and end mounts 108 with fasteners 110. These fasteners 110 in particular may sit flush with surfaces of the longitudinal members 102, 104. Moreover, the brackets 106 and the end mounts 108 may include a root portion 120 that fits within the slots 114 to support the longitudinal members 102, 104.

One of the only differences between the brackets 106 and the end mounts 108 shown in this embodiment is that each bracket 106 has a set of opposing flanges 118, while each end mount 108 has one flange 118. Thus, in the embodiment shown in FIG. 2, an additional longitudinal member could be placed on the flange 118 opposing the flange 118 supporting the first longitudinal member 102. The same can be said for an additional longitudinal member and the flange 118 opposing the flange 118 supporting the second longitudinal member 104.

Figure 3:
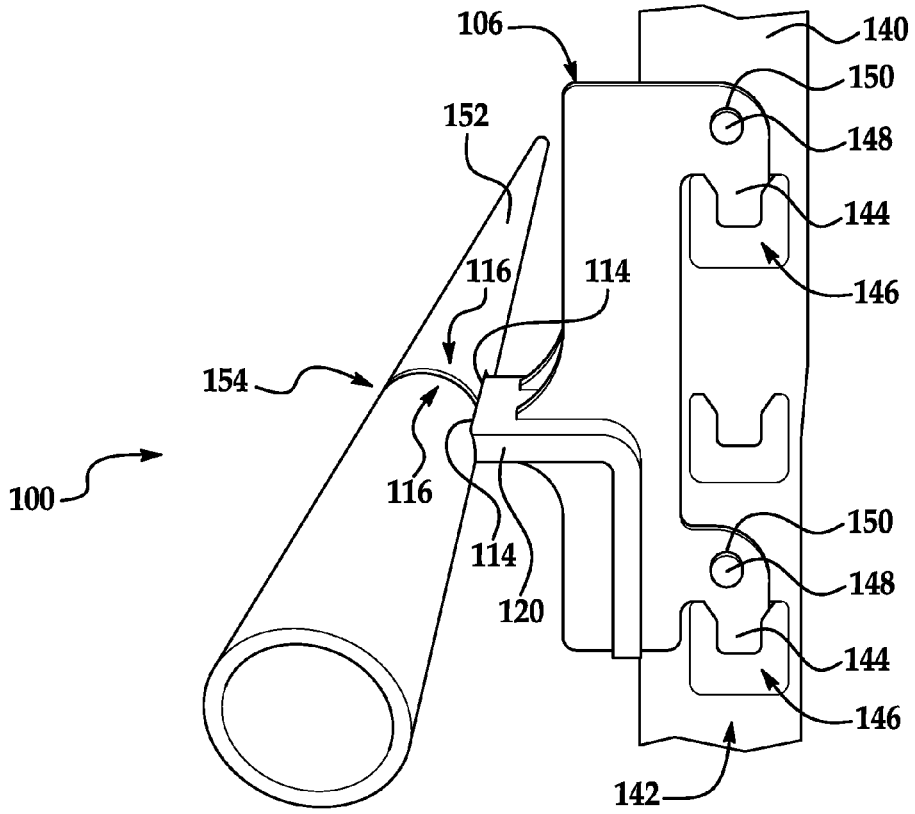
FIG. 3 is a perspective view of the guide track mounted to a storage shelf with a bracket.

With reference now to FIG. 3, one of the plurality of brackets 106 is shown to be attached to a support column 140 of a storage shelf 142. The bracket 106 may in this exemplary embodiment include a pair of tabs 144 that cooperate with and are secured by slotted fixtures 146 alongside the support column 140. A plurality of the slotted fixtures 146 may be disposed alongside the support column 140 such that the height of the bracket 106 and hence the guide track 100, as measured from the floor, can be customized during assembly of the ladder system. Also, the support column 140 may have protrusions 148 that extend through apertures 150 of the brackets 106 once the brackets 106 are attached to the support column 140. The protrusions 148 may further help secure the brackets 106 to the support column 140. Although not shown in FIG. 3, similar points of attachment may exist on an opposing side of the support column 140.

In some embodiments, the shelves, such as shelf 142, including the support columns 140 and the slotted fixtures 146, may be designed and manufactured specifically for use with the disclosed ladder system. In other embodiments, however, the tabs 144 of the brackets 106 may be designed and manufactured specifically for use with existing storage shelves. In the latter set of embodiments, a number of different types of brackets may exist such that the ladder system is compatible with many, if not a majority or even all, existing storage shelves.

Further, in some embodiments, the present invention contemplates that the guide track 100 may have brackets and end mounts that attach to sides of individual shelves, as opposed to the support columns 140. Still further, the term "brackets" may refer generally to both brackets and end mounts.

FIG. 3 also shows two longitudinal members, generally referenced 152, attached to the flanges (not shown) and the root portion 120 of the bracket 106. The root portion 120 of the bracket 106 and the slots 114 of the longitudinal member 152 may be sized so that the ends 116 of the longitudinal members 152 form a virtually seamless joint 154.

Figure 5:
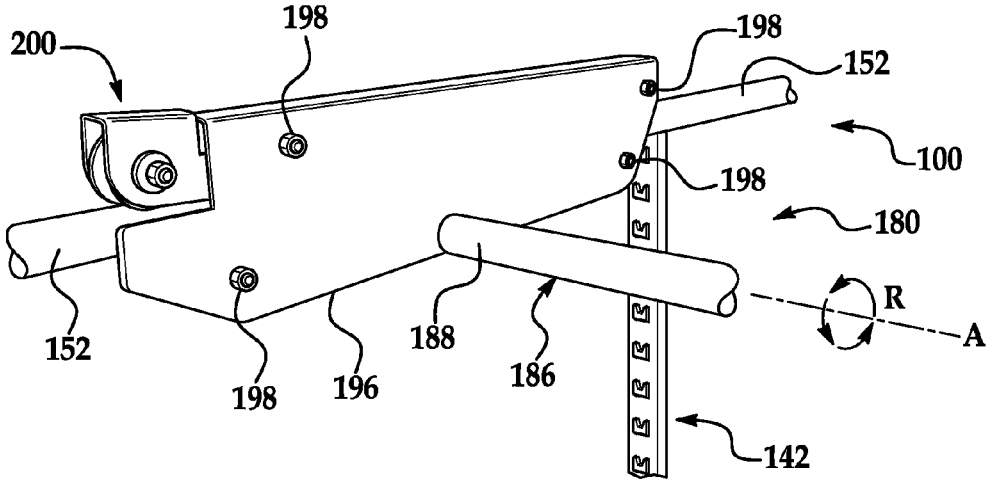
FIG. 5 is a partial perspective view of the roller structure, with the roller structure being slidably attached to a segment of the guide track, which is mounted to a storage shelf.
Figure 4:
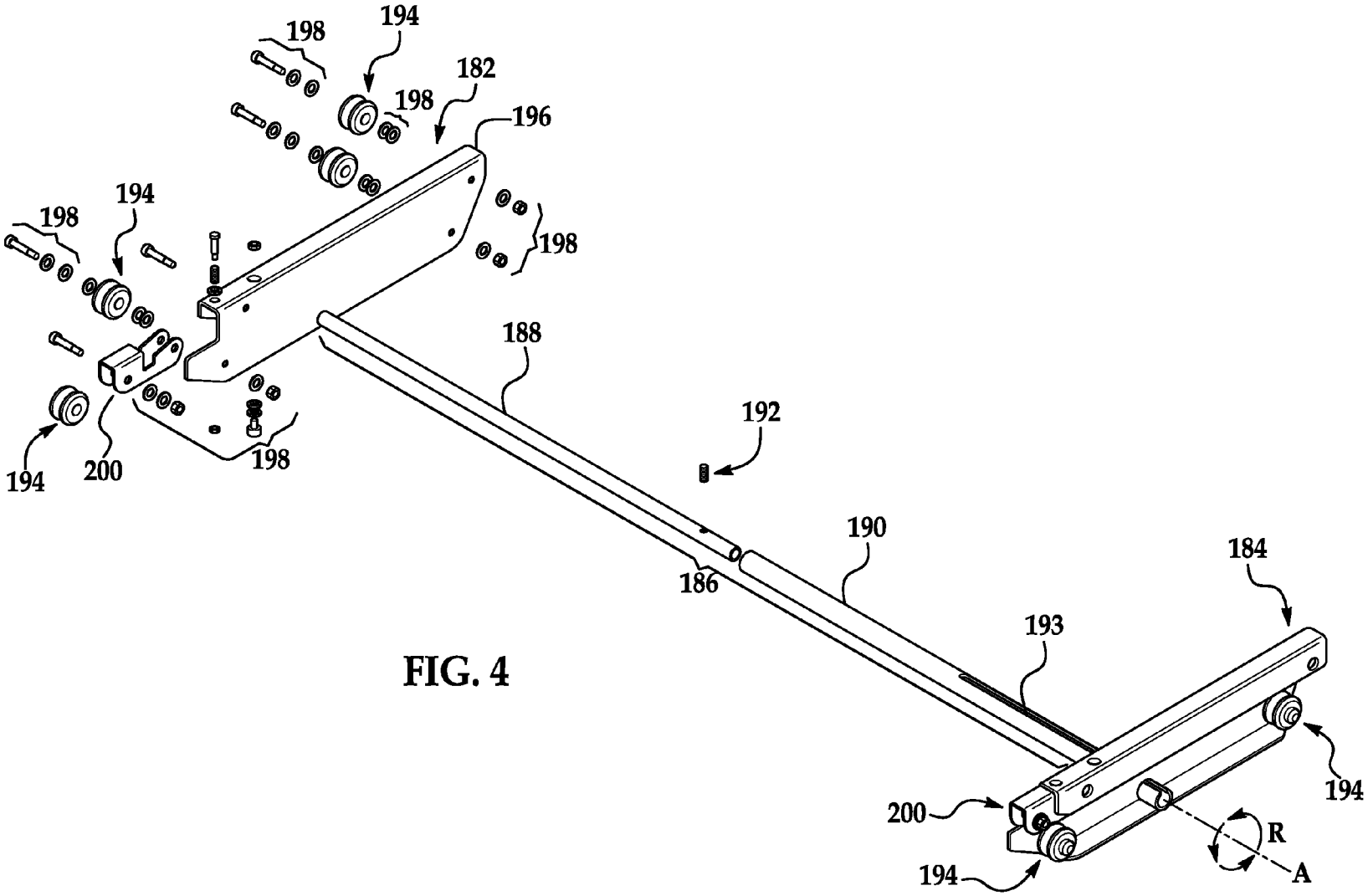
FIG. 4 is a partially exploded perspective view of a roller structure according to an embodiment of the present invention.

An exemplary embodiment of a roller structure 180 (or, alternatively, "support structure") is shown in FIGS. 4-5, referred to collectively unless otherwise specified. In general, the roller structure 180 may be intended to translate along the guide track 100 described above with reference to FIGS. 2-3. Thus, the roller structure 180 may travel longitudinally after the roller structure 180 is mounted on the guide track 100.

In one embodiment, the roller structure 180 may include first and second roller carriages 182, 184. The roller carriages 182, 184 have also been referred to as "side walls" in the field. The first roller carriage 182 is shown exploded in FIG. 4, while the second roller carriage 184 is shown intact. The roller structure 180 may also include a lateral rod 186 formed by a first rod 188 and a second rod 190. The first rod 188 may be welded, fastened, or otherwise affixed to the first roller carriage 182. Likewise, the second rod 190 may be welded, fastened, or otherwise affixed to the second roller carriage 184. One exemplary way in which the first and second rods 188, 190 may be joined to form the lateral rod 186 is by making the first rod 188 smaller in diameter than that of the second rod 190. The first rod 188, then, may be inserted into the second rod 190 during assembly of the ladder system. The first and second rods 188, 190 may be secured by at least one fastener 192, which may or may not be pre-assembled to one or both of the first and second rods 188, 190.

To accommodate aisles of varying widths, several apertures or elongate slots such as slot 193 may be extruded in the first rod 188, the second rod 190, or both the first and second rods 188, 190, particularly where overlap would be likely to occur. When the first and second rods 188, 190 are joined, the fastener 192 may be fitted to an appropriate one of the apertures or elongate slots 193 according to the width of the aisle. Therefore, the lateral rod 186 may be sized appropriately for the width of the aisle in which the ladder system is installed.

The fastener 192 and slot 193 may allow a length of the lateral rod 186 to decrease and increase depending on any variation of width along the length of the aisle. In such embodiments, the fastener 192 may be free to travel along the slot 193. Thus, where the width of an aisle decreases, the effective length of the lateral rod 186 may decrease. Where the width of the aisle increases, the effective length of the lateral rod 186 may increase. In still other embodiments, the lateral rod 186 may include one or more telescopic features that allow the effective length of the lateral rod 186 to vary.

Still referring to FIGS. 4-5, the first and second roller carriages 182, 184 may include a plurality of wheels 194, which are concealed in FIG. 5. The wheels 194 may contact the guide track 100, more specifically, the longitudinal members 152, once the roller structure 180 is mounted to the guide track 100. The wheels 194 allow for the roller carriages 182, 184 to translate along the guide track 100. The wheels 194 may be connected to a frame 196 of the roller carriages 182, 184 via fasteners, bearings, spacers, washers, nuts, and the like, as generally referenced by 198.

In one embodiment, each roller carriage 182, 184 may have two pairs of wheels 194. One wheel 194 of each pair may ride along an upper portion of the longitudinal members 152, and one wheel 194 of each pair may ride along a lower portion of the longitudinal members 152.

Further, in some embodiments, each pair of wheels 194 may be staggered such that one wheel 194 is not directly above the other wheel 194. Thus, if looking at a pair of wheels 194 from the side, the wheels may be said to be horizontally and vertically offset. Or put another way, the wheels may be at an oblique angle with the guide track 100. This staggered design may help reduce stress on the guide track 100 and stress on the components of the roller carriages 182, 184 for the following reason. A ladder, which is described below with reference to FIG. 6, can be connected to the lateral rod 186. When a user steps from the floor onto the ladder, a base of the ladder, which is described below with reference to FIG. 9, may be displaced. However minor, this displacement can cause the ladder to rotate the lateral rod 186, generally about the lateral rod 186. If the wheels 194 in each pair were directly above and below the longitudinal member 152, respectively, in a vertical stack, the rotation of the ladder and hence lateral rod 186 would cause moments about segments of the longitudinal members 152. These segments in addition to the wheels 194, fasteners 198, and frame 196 would be under considerable stress, strain, and/or torque while a user stands on the ladder.

By angling the pair of wheels 194 on the guide track 100, however, the roller carriages 182, 184 are permitted to rotate ever so slightly when a user steps onto the ladder. Thus, the moments described above are prevented. It follows that all eight wheels 194 shown in the embodiment of FIG. 4 may not necessarily be in full contact with the longitudinal members 152 at all times. In some instances, for example, only one of each pair of wheels 194 may be in full contact with the longitudinal members 152. If assembled correctly, there should be enough clearance between the wheels 194 such that after displacement of the ladder, the weight of the user that caused the displacement and rotation of the roller structure 180 is substantially supported through the base of the ladder against the floor—not through the longitudinal members 152 of the guide track 100. It should be noted that moments such as these may also be avoided by allowing enough clearance in a pair of vertically stacked wheels, but with staggered pairs of wheels, less clearance is required.

In some embodiments, each roller carriage 182, 184 may also include a brake 200. In other embodiments, only one of the roller carriages 182, 184 may include the brake 200. The brake(s) 200 may prevent or at least substantially prevent the roller carriages 182, 184 from sliding or translating along the guide track 100 as a user stands on the ladder. Considering a hypothetical rotation R about an axis A, for example, as shown in FIGS. 4-5, the brakes 200 may be forced downward against an upper surface of the longitudinal members 152 of the guide track 100 when a load of sufficient weight is applied to the ladder, such as, for example, a user stepping on the ladder. As the load is removed from the ladder (e.g., the user steps off the ladder) the roller carriages 182, 184 and hence the brakes 200 return to a neutral position in which the roller structure 180 may once again translate along the guide track 100.

In still another embodiment, the lateral rod 186 may be rotatably coupled to the frames 196 of the roller carriages 182, 184. For example, the lateral rod 186 may be rotatably coupled to the frames 196 at bearings (not shown) within the frames 196. Thus, the moments described above at the roller structure 180 and guide track 100 would be virtually nonexistent.

Figure 6:
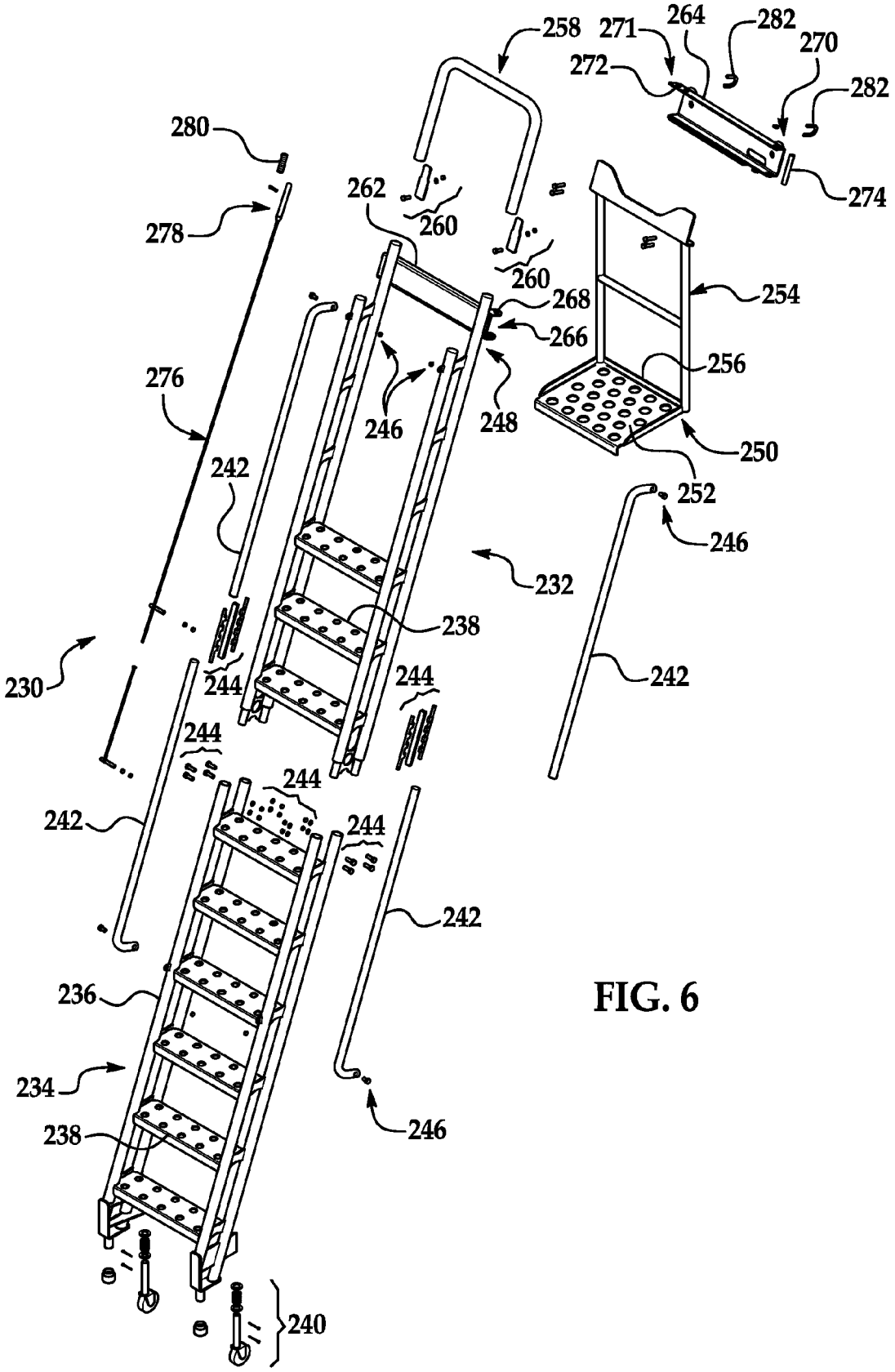
FIG. 6 is an exploded view of a ladder that can be affixed to the roller structure.

FIG. 6 shows one embodiment of a ladder 230 that may be used with the roller structure 180 and the guide track 100, described above. In this particular embodiment, the ladder 230 is shown to be formed of an upper segment 232 and a lower segment 234. Manufacturing the ladder 230 in two segments may be advantageous for shipping and storing purposes. In other embodiments, the ladder 230 may be formed of more than two segments, or may be formed of a single structure.

More specifically, the ladder 230 may include a frame 236 with steps 238 disposed between the frame 236. The ladder 230 may also include a base 240, as described more fully with respect to FIG. 9, and handrails 242 in some embodiments. The handrails 242, too, may be manufactured as separate segments. Where the ladder 230 and handrails 242 are manufactured as segments that require further assembly, a plurality of fasteners 244 may be used to join the segments together. Other fasteners 246 may be used to secure the handrails 242 to the frame 236 of the ladder 230. In other embodiments, the handrails 242 may not be necessary, as the frame 236 may act as a form of handrail for a user.

In some embodiments, as opposed to having steps 238 all the way to a top 248 of the ladder 230, the ladder 230 may include a platform 250 on which a user may stand. In particular, the platform 250 may include a base plate 252 and an upright 254. The user's feet may rest on the base plate 252 while the user's mid-torso or upper body rests against the upright 254 to steady himself or herself. The base plate 252 may include a lip 256 on one or more sides of the base plate 252. In FIG. 6, the lip 256 is shown on three sides of the base plate 252. The lip 256 may help indicate the edges of the base plate 252 to the user, along with helping to keep the user's feet from slipping off the base plate 252.

In addition or in the alternative to the platform 250, the ladder 230 may further include an upper handle 258 that can be attached to the ladder 230 in some embodiments. The upper handle 258 may be useful for a user standing at or towards the top 248 of the ladder 230. Whether the user is standing on the steps 238 or the platform 250, the upper handle 258 may be a further object on which the user may steady himself or herself. The upper handle 258 may be attached to the ladder 230 with fasteners 260.

Also shown in the exemplary embodiment of FIG. 6 are a cross plate 262 and a mounting plate 264. The cross plate 262 may also be referred to as a "securement structure." The cross plate 262 may extend between the frame 236 near the top 248 of the ladder 230. The cross plate 262 may, in one embodiment, be welded to the frame 236. The cross plate 262 may have on both ends a pair of spaced flanges 266 with slots 268 in each flange 266. In some embodiments, the cross plate 262 is considered a part of the ladder 230. In other embodiments, the cross plate 262 may be treated as a separate component.

In one embodiment, the mounting plate 264 may be generally sized and shaped to mate with the cross plate 262. For example, a width of the mounting plate 264 may approximate a width of the cross plate 262. The mounting plate 264, moreover, may include a pair of spaced flanges 270 on one end and another flange 271 on another end distal to the pair of spaced flanges 270. The flanges 270, 271 may have slots 272 as well. Further, a height of the mounting plate 264 may be slightly taller than a height of the cross plate 262 so that the cross plate 262 may fit partially within the mounting plate 264 at times. As described further below, when the cross plate 262 and the mounting plate 264 come together, the slots 268 of the spaced flanges 266 of the cross plate 262 may coincide with the slots 272 of the flanges 270, 271 of the mounting plate 264.

In fact, the cross plate 262 may be pivotally attached to the mounting plate 264 at a pivot 274. As shown and described below, specifically with respect to FIG. 15, the pivot 274 may be secured through the slots 268 of one of the pairs of spaced flanges 266 on the cross plate 262 and also through the slots 272 of the flanges 270 of the mounting plate 264.

Still referring to FIG. 6, a cable 276 may be provided alongside the ladder 230. In one embodiment, the cable 276 may be connected to a pin 278 that may be selectively positioned through the slots 268, 272 of the flanges 266, 271 of the cross plate 262 and the mounting plate 264 opposite the pivot 274. As also described below, the pin 278 may also be fed through a spring 280 to form a latch mechanism (not shown) that helps maintain the ladder 230 in a deployed position.

In one embodiment, the ladder 230 may be attached to the roller structure 180 (not shown) at the mounting plate 264. More specifically, U-bolts 282 may attach the lateral rod 286 (not shown) to the mounting plate 264. The mounting plate 264 may have slots (not shown) to receive the U-bolts 282, which may be secured by fasteners, as the lateral rod 186 is held against the mounting plate 264.

Figure 7:
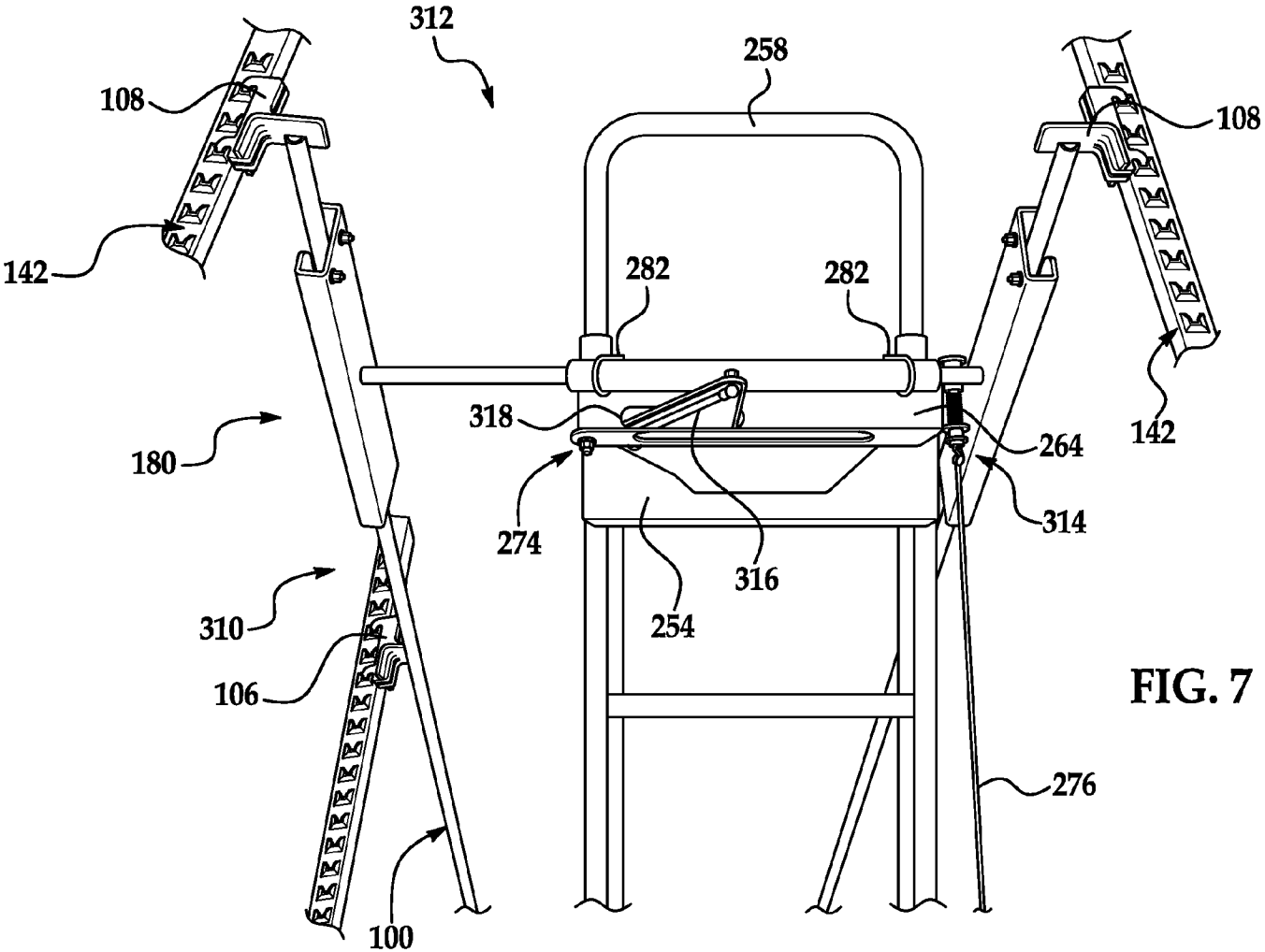
FIG. 7 is a partial perspective view of the ladder system where the ladder is affixed to the roller structure, with the roller structure being slidably attached to segments of the guide track that are mounted along storage shelves.

Turning to FIG. 7, a ladder system 310 is shown in a deployed position 312. In some embodiments, the ladder system 310 may generally include the ladder 230, the roller structure 180, and the guide track 100. The ladder 230 may be attached to the mounting plate 264 by the U-bolts 282. In turn, the mounting plate 264 may be pivotally attached to the cross plate 262 of the ladder 230 at the pivot 274. Here, in the deployed position 312, the mounting plate 264 may also be attached to the cross plate 262 by a latch mechanism 314. The latch mechanism 314, described further below, may be selectively disengaged when a user wishes to pivot the ladder 230 from the deployed position 312 to a folded position to clear the aisle. As also described below, to aid pivoting the ladder 230 from the deployed position 312 to a folded position, the ladder system 310 may also include a piston 316 that extends through a slot 318 in the mounting plate 264.

Figure 8:
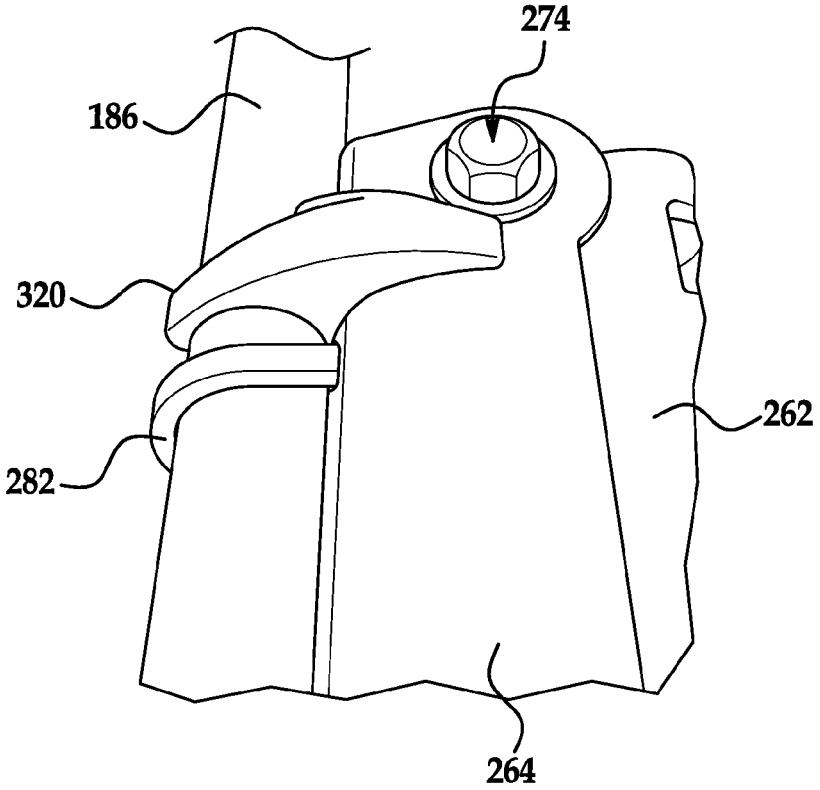
FIG. 8 is a partial perspective view of a U-bolt attaching the ladder to a lateral rod of the roller structure.

Referring now to FIG. 8, a close up view is shown of one of the U-bolts 282 attaching the lateral rod 186 to the mounting plate 264. The cross plate 262 is shown to be positioned partially within the mounting plate 264, as the ladder system 310 is in the deployed position 312. As described above, the cross plate 262 may be pivotally attached to the mounting plate 264 by the pivot 274.

FIG. 8 also shows a hook 320 according to one exemplary embodiment of the present invention. The mounting plate 264 may have one or more hooks 320 that protrude off the mounting plate 264 and partially follow the contour of the lateral rod 186. The hooks 320 may be helpful when securing the ladder 230 to the roller structure 180, before one or more U-bolts 282 are secured around the lateral rod 186 and into the mounting plate 264. In effect, the hooks 320 may grab the lateral rod 186 temporarily and maintain the ladder 230 in place. It is recommended, though, that the person assembling the ladder system 310 use an independent ladder to secure the U-bolts 282, as the hooks 320 may be insufficient to hold the ladder 230 against the lateral rod 186 as a person is climbing up the ladder 230.

One advantage of the U-bolts 282 is that they reduce the cost of the ladder system 310. As noted above, the ladder system 310 may be particularly advantageous for use in aisles where the ladder 230 does not need to be moved laterally with frequency. But even if the ladder 230 needs to be moved laterally, the U-bolts 282 may simply be loosened, the ladder 230 moved sideways, and the U-bolts 282 retightened.

Figure 9:
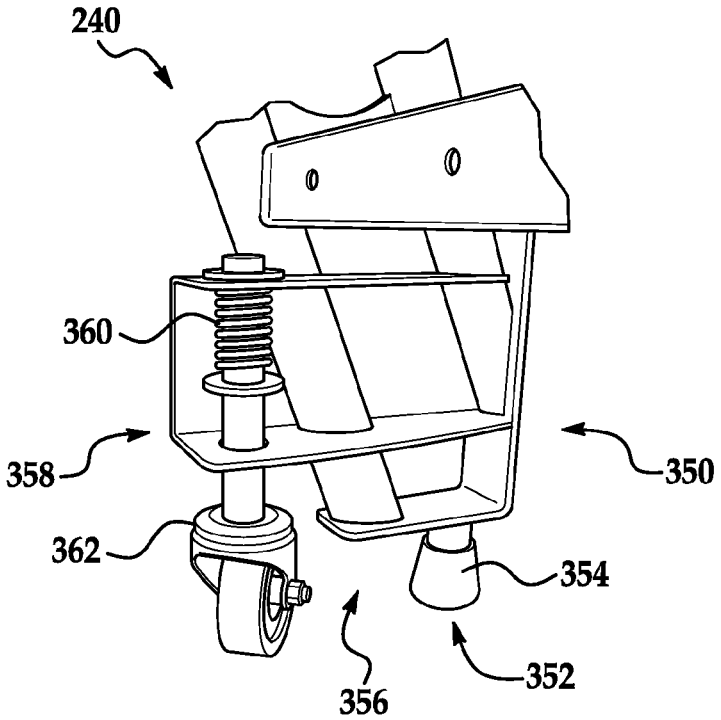
FIG. 9 is a side view of a part of a base of the ladder.

One embodiment of the base 240 of the ladder 230 is shown in FIG. 9. In this embodiment, the base 240 may have two primary states: a loaded state 350 and an unloaded state. The base 240 in FIG. 9 is shown in the loaded state 350. In the loaded state 350, a user may be standing on the ladder 230. Adding weight of the user to the ladder 230 may force a peg 352 of the base 240 downward, into the loaded state 350. The peg 352 may be covered with a rubber stopper 354 that prevents or substantially prevents movement between a floor 356 and the peg 352. As the peg 352 is forced downwards, a spring-loaded wheel 358 of the base 240 may be compressed.

In this embodiment, a spring 360 of the spring-loaded wheel 358 should be strong enough to cause the peg 352 of the base 240 and hence the ladder 230 to shift upwards when the ladder 230 is not bearing a person's weight. This is known as the unloaded state, and the base 240 may be free to roll along the floor 356 on the spring-loaded wheel 358. The spring 360 may not be too strong, however, so as to prevent the weight of average-sized individuals from compressing the spring 360. Further, the spring-loaded wheel 358 may include a swivel 362 that allows the spring-loaded wheel 358 to pivot and travel in any direction.

Figure 10:
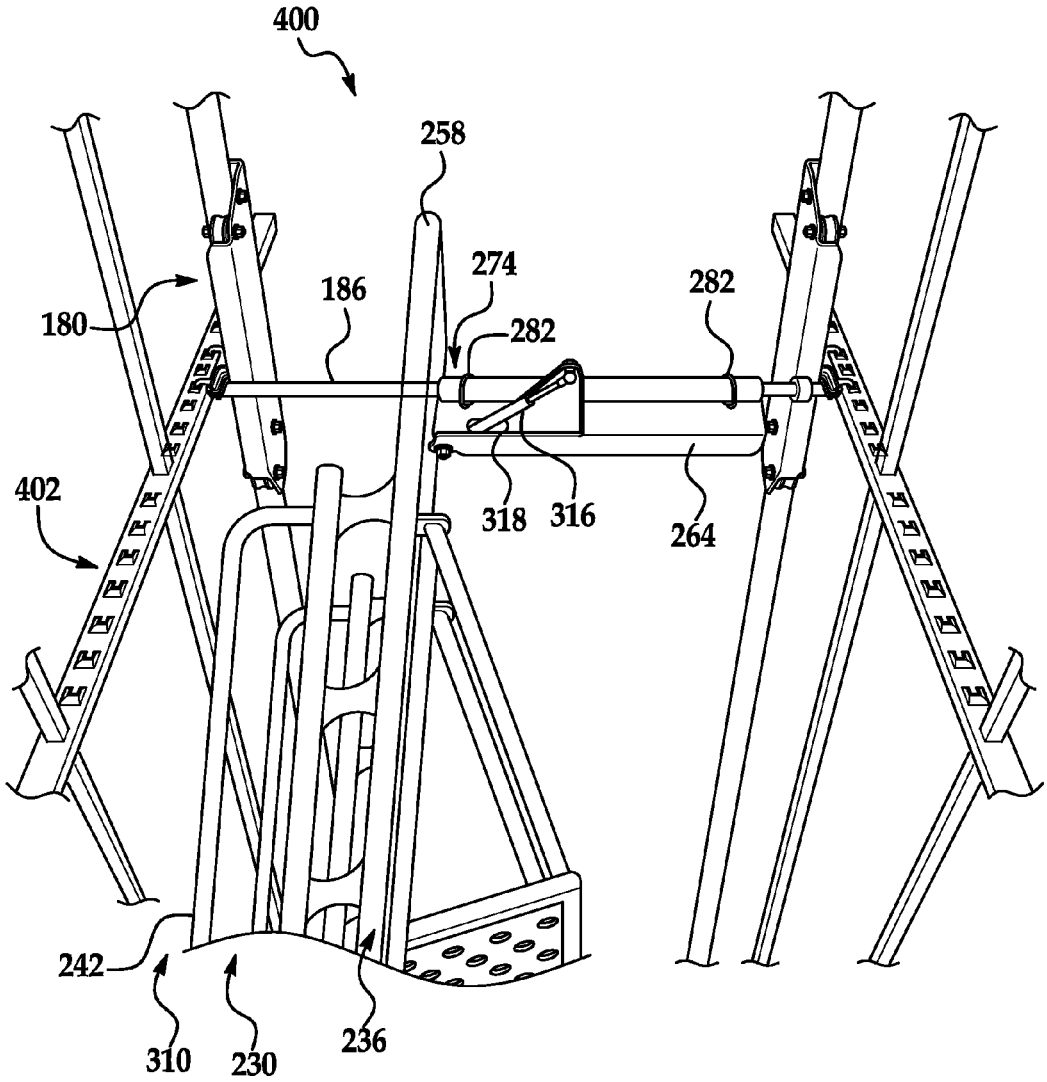
FIG. 10 is a partial perspective view of the ladder system with the ladder in a folded position adjacent to one of the shelves.

FIG. 10 shows a perspective view of the ladder system 310 similar to that shown in FIG. 7, except that the ladder system 310 shown in FIG. 10 is in a folded position 400. The mechanics of how the ladder system 310 is moved from a deployed position 312 to the folded position 400 are shown and described with respect to the remaining figures. However, FIG. 10 is helpful in showing how the ladder 230 may be positioned substantially out of the aisle and against a storage shelf 402 in the folded position 400. FIG. 10 also shows that according to one embodiment, the mounting plate 264 may remain in place as the ladder 230 is folded. As shown, the U-bolts 282 maintain the mounting plate 264 affixed to the lateral rod 186.

Figure 11:
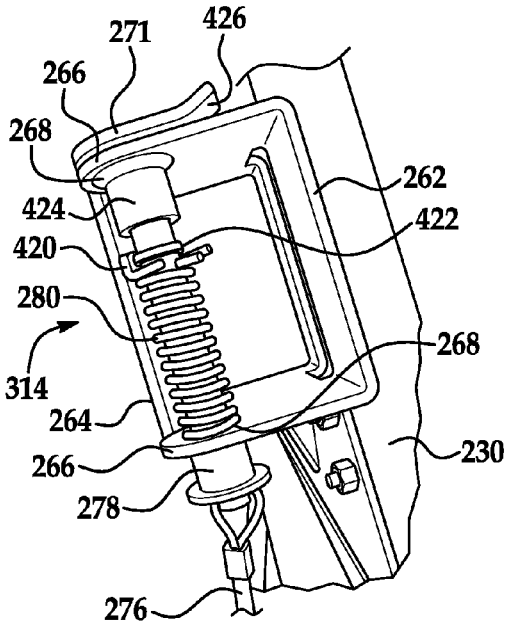
FIG. 11 is a side view of one embodiment of a latch that can be used to maintain the ladder in a deployed position.

Now referring to FIG. 11, one embodiment of the latch mechanism 314 is shown. The latch mechanism 314 may operate to selectively release the ladder 230 from the deployed position 312 so that the ladder 230 may be moved to the folded position 400. When a user wishes to selectively disengage the latch mechanism 314, he or she may pull downwards on a cable 276 kept alongside the ladder 230. The cable 276 may be attached to the pin 278 that is inserted through the slots 268 on the flanges 266 of the cross plate 262. The pin 278 may also be inserted through the spring 280, which may be maintained between a catch mechanism 420 disposed on a recess 422 in the pin 278 and the flange 266 of the cross plate 262. As the cable 276 is pulled downwards, the pin 278 slides downward and compresses the spring 280 between the catch mechanism 420 and the flange 266 of the cross plate 262. A tip (not shown) of the pin 278, formerly disposed in the slot 272 (not shown) of the flange 271 of the mounting plate 264, may likewise slide downward such that the slot 272 is free of the tip of the pin 278. The tip may slide down into a collar 424 disposed underneath the flange 266 of the cross plate 262. As described below, when this happens, the piston 316 may pivot the ladder 230 and the cross plate 262 away from the mounting plate 264.

Figure 12:
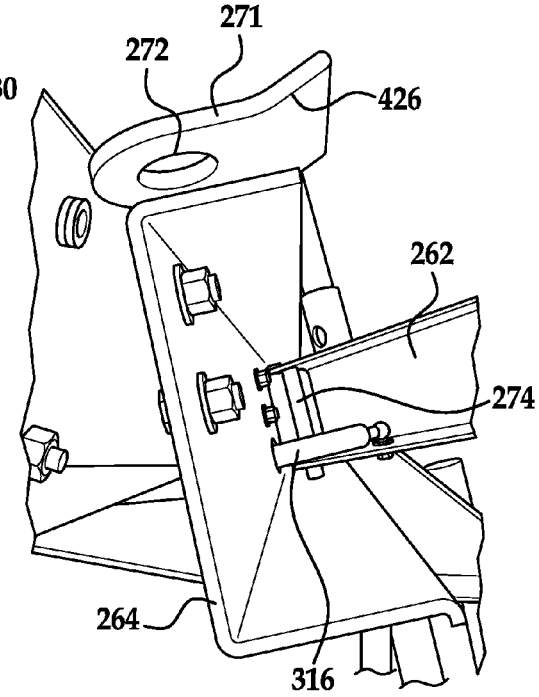
FIG. 12 is a side view of part of the latch shown in FIG. 11, except that the latch has been disengaged and the ladder is traveling towards the folded position.

FIG. 12 shows a view of the mounting plate 264, the flange 271, and the slot 272 as the cross plate 262 begins to rotate away from the mounting plate 264. At this point, the user may release the cable 276. As a result, the spring 280 may force the pin 278 back to its neutral state.

When the ladder 230 is returned to the deployed position 312, the pin 278 must be lowered before it re-enters the slot 272 (not shown) of the flange 271 of the mounting plate 264. One possible way to cause this to happen is to curve the flange 271 as shown at 426. Curvature 426 of the flange 271, then, forces the tip of the pin 278 downwards as the cross plate 262 approaches the mounting plate 264. Once the flanges 266 of the cross plate 262 are far enough underneath the flange 271, the spring 280 forces the tip of the pin 278 back through the slot 272 of the flange 271 of the mounting plate 264.

It should be noted that FIGS. 11-12, like all other figures, depict merely exemplary embodiments of the latch mechanism 314. Although the above embodiments refer to a "latch" mechanism, the latch mechanism 314 should be understood to encompass a broad range of closure devices, such as levers, for example.

Figure 13:
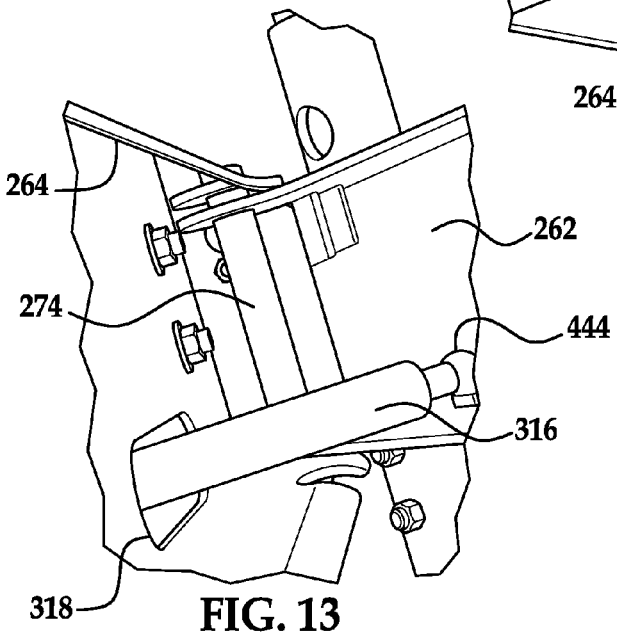
FIG. 13 is a side perspective view of a piston used to force the ladder into the folded position after the latch is disengaged.
Figure 14:
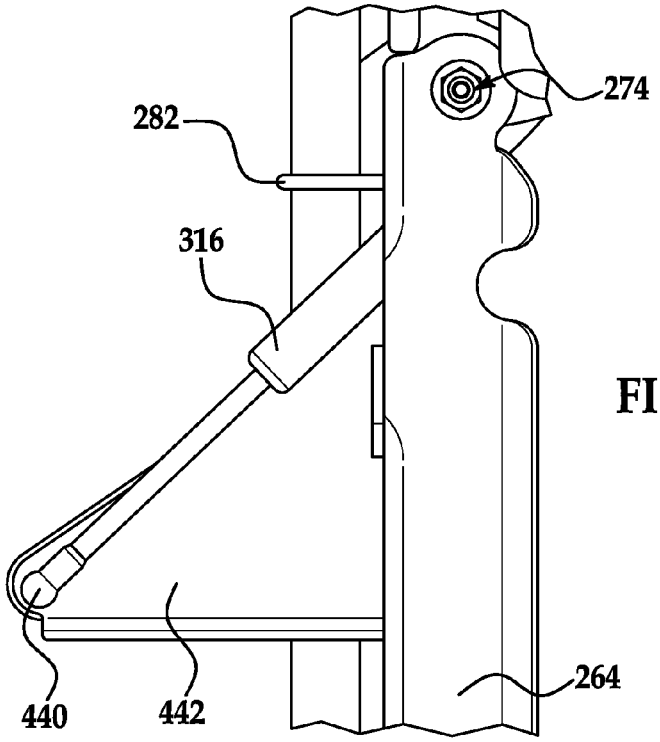
FIG. 14 is a top view of an attachment point between the piston and a bracket of a mounting bar.

FIGS. 13-14 present still better views of the piston 316 forcing the cross plate 262 from a deployed position 312 to the folded position 400. The piston 316 may be attached to the mounting plate 264 at a rotatable joint 440 on a bracket 442 that extends from the mounting plate 264. The piston 316 may extend from the rotatable joint 440, through the slot 318 in the mounting plate 264, and connect to another rotatable joint 444 on the cross plate 262. As described above, the mounting plate 264 and the cross plate 262 may be pivotally attached by the pivot 274 that passes through the flanges 270, 271 of the mounting plate 264 and the cross plate 262. The piston 316 may be above or below the bracket 442. When the latch mechanism 314 is selectively disengaged, the piston 316 may exert outward forces on the mounting plate 264 and the cross plate 262, driving the cross plate 262 away from the mounting plate 264. These forces may cause the ladder 230 to pivot to the folded position 400 as described above.

The piston 316 is merely exemplary, as the present invention contemplates other embodiments, too. For example, as opposed to the piston 316, a torsion spring with two ends may be coiled around portions of the pivot 274. The ends of the torsion spring may force the mounting plate 264 and the cross plate 262 apart from one another.

Figure 15:
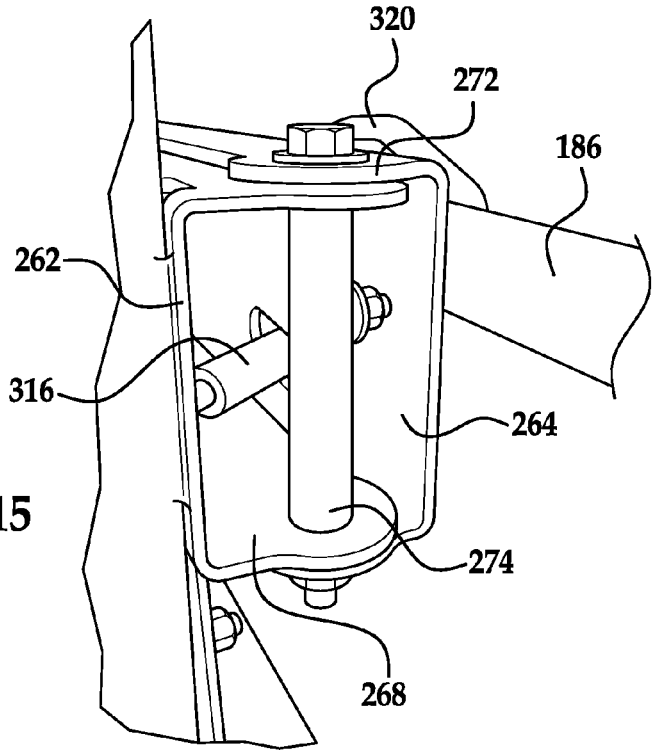
FIG. 15 is a side view of a pivot about which the ladder can be pivoted to arrange the ladder in the folded position and the deployed position.

FIG. 15 shows a mirror image of the pivot 274. As already described, the mounting plate 264 and the cross plate 262 may be pivotally attached by the pivot 274 that passes through the flanges 270, 271 of the mounting plate 264 and the cross plate 262. FIG. 15 also shows an additional view of one of the hooks 320.

It should also be understood that other types of ladders, such as those having safety structures including platforms or gates, may incorporate the inventive structure. Moreover, the ladder 230 may be formed of wood, any suitable metal, or other appropriate material.

In closing, it should be noted that the present invention is not limited to the above mentioned embodiments and exemplary working examples. Further developments, modifications, and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. A ladder system for an aisle formed by a pair of storage shelves that are positioned on a floor, a longitudinal direction extending parallel to the storage shelves and a lateral direction extending between the storage shelves, the ladder system comprising:

a guide track adapted to be attached to the pair of storage shelves, the guide track extending in the longitudinal direction;

a roller structure slidably attached to the guide track, the roller structure having a first roller carriage and a second roller carriage, with the first roller carriage adjacent to one of the pair of storage shelves and the second roller carriage adjacent to another one of the pair of storage shelves, the roller structure having a lateral rod extending between and coupled to the first and second roller carriages;

a mounting plate affixed to the lateral rod of the roller structure, the mounting plate having first and second ends, the first end being generally distal to the second end, the mounting plate comprising (i) a first flange at the first end and having at least a first slot, and (ii) a second flange at the second end and having at least a second slot;

a ladder having a cross-plate mounted thereto, said cross-plate having first and second ends with respective first and second slots, the cross-plate being pivotally attached to the mounting plate by a pivot, the pivot being disposed through the respective first slots of the mounting plate and cross-plate such that the ladder can rotate relative to the roller structure between a deployed position and a folded position away from the deployed position, the ladder further having a base that contacts the floor; and a latch mechanism configured to selectively secure the second end of the cross-plate to the second end of the mounting plate to thereby secure the ladder to the roller structure in the deployed position, the latch mechanism comprising a pin disposed through the second slot of the cross-plate and normally biased toward an extended state, the latch mechanism being engaged when the pin, while extended, is further disposed in the second slot of the mounting plate to thereby hold the cross-plate and mounting plate together.

2. The ladder system of claim 1 further comprising at least one U-bolt, wherein the lateral rod is affixed to the mounting plate by the at least one U-bolt.

3. The ladder system of claim 1 further comprising at least one hook protruding from the mounting plate, wherein the at least one hook is configured to grab the lateral rod of the roller structure at least during assembly of the ladder system.

4. The ladder system of claim 1 wherein the latch mechanism is configured, through manual actuation, to overcome the biasing of the pin to retract and withdraw the pin from the second slot of the mounting plate to thereby disengage the latch mechanism wherein disengaging the latch mechanism allows the ladder to be pivoted about the pivot to the folded position, wherein the ladder is adjacent to one of the pair of storage shelves in the folded position.

5. The ladder system of claim 1 wherein the first and second roller carriages further comprise respective pairs of wheels, wherein at least one of the pairs of wheels has a first wheel and a second wheel, with the first wheel being horizontally and vertically offset from the second wheel.

6. The ladder system of claim 1 wherein the ladder further comprises a platform having a base plate with a plurality of sides and an upright, wherein users can stand on the base plate and steady themselves against the upright, wherein the base plate comprises a lip disposed along at least one of the plurality of sides.

7. The ladder system of claim 1 further comprising a piston rotatably coupled to the mounting plate and rotatably coupled to the ladder, wherein the piston drives the ladder from the deployed position to the folded position where the latch mechanism is disengaged.

8. The ladder system of claim 1 wherein the latch mechanism includes a cable that is attached to the pin for selectively removing the pin from the second slot of the mounting plate.

9. The ladder system of claim 1 wherein said second flange of said mounting plate includes a curvature configured to force a tip of said pin downwards as the cross-plate approaches the mounting plate.

10. A ladder system for an aisle formed by a pair of storage shelves that are positioned on a floor, a longitudinal direction extending parallel to the storage shelves and a lateral direction extending between the storage shelves, the ladder system comprising:

a guide track having first and second longitudinal members adapted to be attached to the pair of storage shelves, the guide track extending in the longitudinal direction;

a roller structure slidably attached to the longitudinal members of the guide track, the roller structure having a first roller carriage and a second roller carriage, with the first roller carriage slidably attached to the first longitudinal member and the second roller carriage attached to the second longitudinal member, the roller structure having a lateral rod extending between and coupled to the first and second roller carriages;

a mounting plate affixed to the lateral rod of the roller structure with at least one U-bolt, the mounting plate having first and second ends, the first end being distal to the second end, the mounting plate comprising (i) a first flange at the first end and having at least a first slot, and (ii) a second flange at the second end and having at least a second slot;

a ladder having a cross-plate mounted thereto, said cross-plate having first and second ends with respective first and second slots, the cross-plate being pivotally attached to the mounting plate by a pivot, the pivot being disposed through the respective first slots of the mounting plate and cross-plate such that the ladder can rotate relative to the roller structure between a deployed position and a folded position away from the deployed position, the ladder further having a base that contacts the floor; and a latch mechanism configured to selectively secure the second end of the cross-plate to the second end of the mounting plate to thereby secure the ladder to the roller structure in the deployed position, the latch mechanism comprising a pin disposed through the second slot of the cross-plate and normally biased toward an extended state, the latch mechanism being engaged when the pin, while extended, is further disposed in the second slot of the mounting plate to thereby hold the cross-plate and mounting plate together.

11. The ladder system of claim 10 further comprising at least one hook protruding from the mounting plate, wherein the at least one hook is configured to grab the lateral rod of the roller structure.

12. The ladder system of claim 10 wherein the latch mechanism is configured, through manual actuation, to overcome the biasing of the pin to retract and withdraw the pin from the second slot of the mounting plate to thereby disengage the latch mechanism wherein disengaging the latch mechanism causes a piston to pivot the ladder about the pivot to the folded position, wherein the ladder is adjacent to one of the pair of storage shelves in the folded position.

13. The ladder system of claim 10 wherein the first and second roller carriages further comprise respective pairs of wheels, wherein at least one of the pairs of wheels has a first wheel and a second wheel, wherein a line between the first and second wheels is oblique to one of the first longitudinal member and the second longitudinal member.

14. The ladder system of claim 10 wherein the ladder further comprises a platform having a base plate with a plurality of sides and an upright, with the upright being generally orthogonal to the base plate, wherein users can stand on the base plate and steady themselves against the upright, wherein the base plate comprises a lip disposed along at least one of the plurality of sides.

15. The ladder system of claim 10 further comprising a piston rotatably coupled to the mounting plate and rotatably coupled to the ladder, wherein the piston rotates the ladder from the deployed position to the folded position once the latch mechanism is selectively disengaged.

16. The ladder system of claim 10 wherein the latch mechanism includes a cable that is attached to the pin for selectively removing the pin from the second slot of the mounting plate.

17. A ladder system for an aisle formed by a pair of storage shelves that are positioned on a floor, a longitudinal direction extending parallel to the storage shelves and a lateral direction extending between the storage shelves, the ladder system comprising:

a guide track having first and second longitudinal members attached to the pair of storage shelves, the guide track extending in the longitudinal direction;

a roller structure slidably attached to the longitudinal members of the guide track, the roller structure having a first roller carriage and a second roller carriage, with the first roller carriage slidably attached to the first longitudinal member and the second roller carriage attached to the second longitudinal member, the roller structure having a lateral rod extending between and coupled to the first and second roller carriages;

a mounting plate affixed to the lateral rod of the roller structure with at least one U-bolt, the mounting plate having first and second ends, the first end being distal to the second end, the mounting plate comprising (i) a first flange at the first end and having at least a first slot, and (ii) a second flange at the second end and having at least a second slot;

a ladder having a cross-plate mounted thereto, said cross-plate having first and second ends with respective first and second slots, the cross-plate being pivotally attached to the mounting plate by a pivot, the pivot being disposed through the respective first slots of the mounting plate and cross-plate such that the ladder can rotate relative to the roller structure between a deployed position and a folded position away from the deployed position, the ladder further having a base that contacts the floor, the ladder including a platform having a base plate with a plurality of sides and an upright, with the upright being generally orthogonal to the base plate, wherein users can stand on the base plate and steady themselves against the upright, wherein the base plate comprises a lip disposed along at least one of the plurality of sides, the lip for keeping feet of users on the base plate;

a latch mechanism configured to selectively secure the second end of the cross-plate to the second end of the mounting plate to thereby secure the ladder to the roller structure in the deployed position, the latch mechanism comprising a pin disposed through the second slot of the cross-plate and normally biased toward an extended state, the latch mechanism being engaged when the pin, while extended, is further disposed in the second slot of the mounting plate to thereby hold the cross-plate and mounting plate together; and at least one hook protruding from the mounting plate, wherein the at least one hook is configured to grab the lateral rod of the roller structure.

18. The ladder of claim 17 further comprising at least one of the following:

a piston rotatably coupled to and extending between the ladder and the mounting plate; and a torsion spring having at least two ends, wherein on of the at least one of the two ends contacts the ladder and the other of the at least two ends contacts the mounting plate, wherein the torsion spring forces the ladder away from the mounting plate.

19. The ladder system of claim 18 wherein second slots on both the cross-plate and on the mounting bracket are alignable.

* * * * *

UNITED STATES PATENT AND TRADEMARK OFFICE

CERTIFICATE OF CORRECTION

PATENT NO. : 8,733,502 B2
APPLICATION NO. : 13/474413
DATED : May 27, 2014
INVENTOR(S) : Larson It is certified that error appears in the above-identified patent and that said Letters Patent is hereby corrected as shown below:

In the Claims

Column 14, line 28, Claim 18, delete "wherein on of the" and insert --wherein one of the--.

Signed and Sealed this
Twelfth Day of August, 2014

Michelle K. Lee

Michelle K. Lee
*Deputy Director of the United States Patent and Trademark Office*